US010399244B2

(12) United States Patent
Li

(10) Patent No.: US 10,399,244 B2
(45) Date of Patent: Sep. 3, 2019

(54) METHOD OF MANUFACTURE OF MEDIUM AND HIGH DENSITY FIBREBOARD WITH MOISTURE AND MILDEW RESISTANCE AND LOW FORMALDEHYDE LEVEL

(71) Applicant: Jinan Caiming Industrial Co., Ltd., Jinan (CN)

(72) Inventor: Maohui Li, Jinan (CN)

( * ) Notice: Subject to any disclaimer, the term of this patent is extended or adjusted under 35 U.S.C. 154(b) by 315 days.

(21) Appl. No.: 15/347,634

(22) Filed: Nov. 9, 2016

(65) Prior Publication Data

US 2017/0151690 A1 Jun. 1, 2017

(30) Foreign Application Priority Data

Nov. 26, 2015 (CN) ..... 2015 1 0848870

(51) Int. Cl.

| | |
|---|---|
| ***B27N 3/04*** | (2006.01) |
| ***B27N 1/00*** | (2006.01) |
| ***B27N 1/02*** | (2006.01) |
| ***B27N 3/00*** | (2006.01) |
| ***B27N 3/18*** | (2006.01) |
| ***B27N 3/24*** | (2006.01) |

(52) U.S. Cl.

CPC ..... *B27N 1/003* (2013.01); *B27N 1/006* (2013.01); *B27N 1/0209* (2013.01); *B27N 3/002* (2013.01); *B27N 3/04* (2013.01); *B27N 3/183* (2013.01); *B27N 3/24* (2013.01); *B27N 3/18* (2013.01)

(58) Field of Classification Search

None

See application file for complete search history.

*Primary Examiner* — Jacob T Minskey

(74) *Attorney, Agent, or Firm* — Tsz Lung Yeung

(57) ABSTRACT

A method of manufacture of medium and high density fibreboard with moisture and mildew resistance and low formaldehyde emission, which includes the steps of: (a) providing wood chips; (b) pre-steaming; (c) refining the wood chips into fibers and adding 200-230 kg/m$^3$ urea-formaldehyde resin adhesive, nigrosine solution with a mass percentage of nigrosine in absolutely dried fiber of 1-1.2%, 6-8 kg/m$^3$ refined paraffin and 1.5-2 kg/m$^3$ curing agent; (d) feeding activated carbon of 100-200 mesh to mix with the fibers and then drying the fibers to a water content between 8-10%; (e) separating qualified fibers to measuring silo; (f) laying the fibers onto a mat formation platform uniformly to form a fiber mat by pre-pressing; (g) pre-heating the fiber mat; and (h) processing continuous hot-pressing to form a raw board. The resulting fiberboard is black in color, has good physical properties and low formaldehyde emission rate.

20 Claims, 1 Drawing Sheet

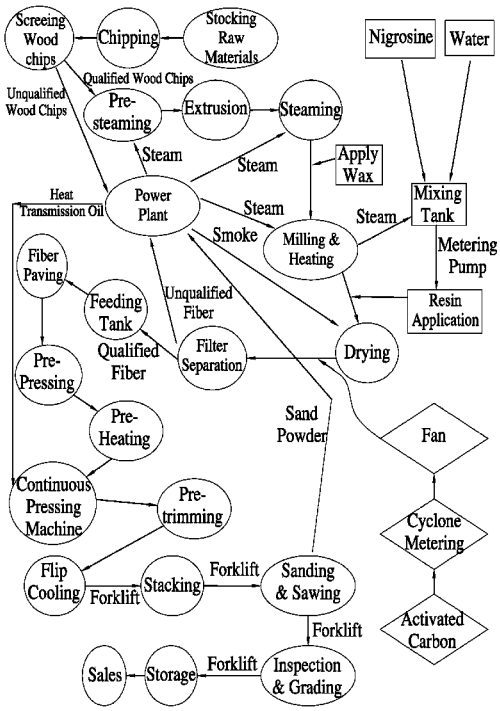

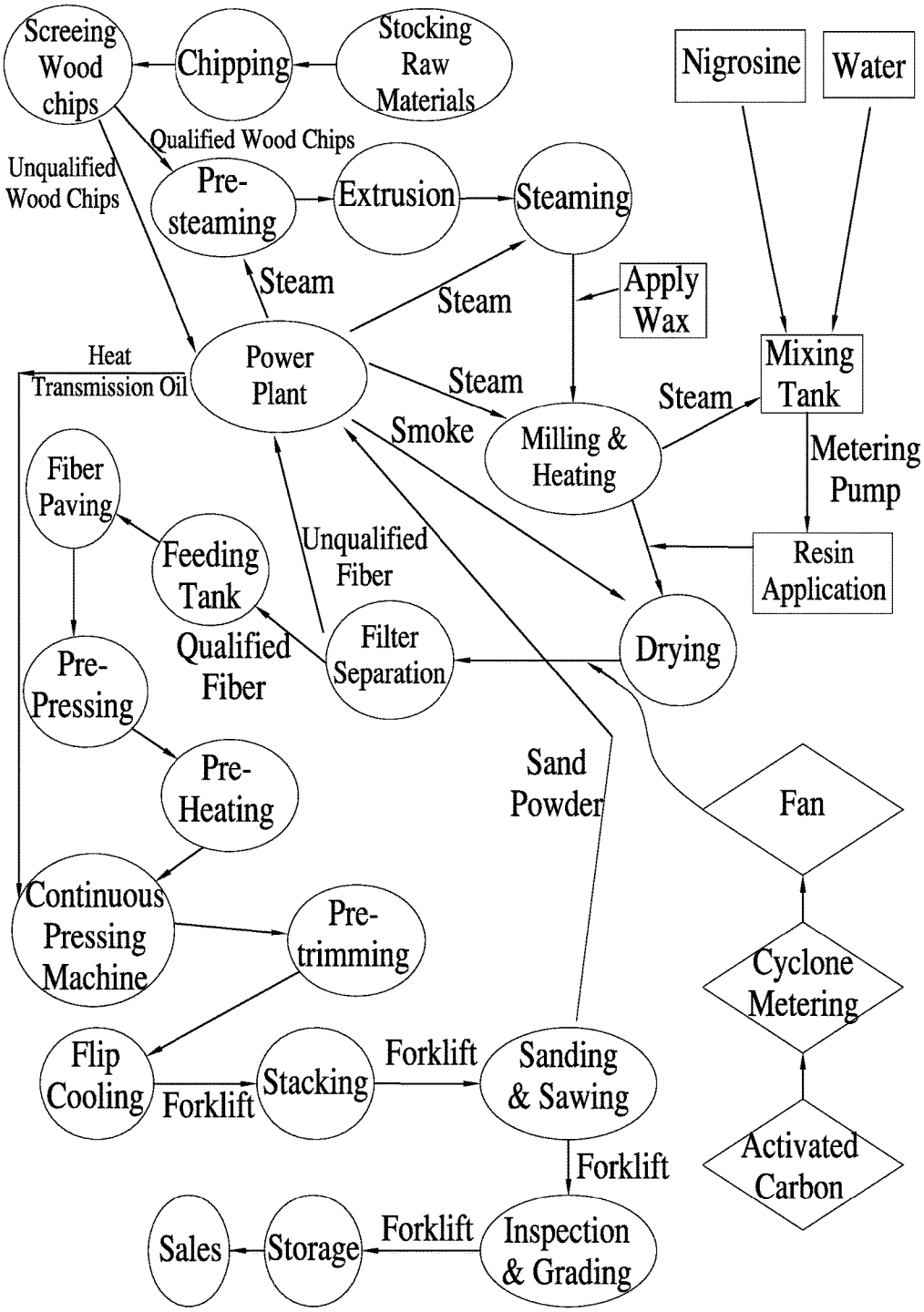
Screeing Wood chips
Chipping
Stocking Raw Materials
Nigrosine
Water
Qualified Wood Chips
Unqualified Wood Chips
Pre-steaming
Extrusion
Steaming
Steam
Steam
Apply Wax
Heat Transmission Oil
Power Plant
Steam
Steam
Mixing Tank
Smoke
Milling & Heating
Metering Pump
Fiber Paving
Feeding Tank
Unqualified Fiber
Resin Application
Qualified Fiber
Filter Separation
Drying
Pre-Pressing
Pre-Heating
Sand Powder
Fan
Continuous Pressing Machine
Pre-trimming
Cyclone Metering
Flip Cooling
Forklift
Stacking
Forklift
Sanding & Sawing
Forklift
Activated Carbon
Sales
Storage
Forklift
Inspection & Grading

METHOD OF MANUFACTURE OF MEDIUM AND HIGH DENSITY FIBREBOARD WITH MOISTURE AND MILDEW RESISTANCE AND LOW FORMALDEHYDE LEVEL

CROSS REFERENCE OF RELATED APPLICATION

This is a national phase patent application which claimed priority of Chinese application number 201510848870.9, filing date Nov. 26, 2015. The contents of this specification are incorporated herein by reference.

BACKGROUND OF THE PRESENT INVENTION

Field of Invention

The present invention relates to a method of manufacture of fiberboard, and more particularly to a method of manufacture of medium and high density fiberboard which is moisture resistant, mildew resistant and has low formaldehyde emission.

Description of Related Arts

In the process of manufacture of wood-based panels, a large quantity of adhesive is used and the adhesive will introduce 'unstable' factors. When the pH is low or when the humidity level is high, the chains of the adhesive will break down and decompose to emit free formaldehyde. Under the action of electrolytes in the heating and pressing process, free formaldehyde will also be emitted. At present, the manufacture of high density fiberboard mainly includes the steps of: preparing materials (by chipping or purchasing wood chips; selecting and cleaning of wood chips, pre-steaming, steaming, milling and heating, adjusting and applying glue, drying, mat forming, pre-pressing, hot pressing, cutting, cooling, sanding, sawing and quality inspection. The medium and high density fiberboards manufactured by the above conventional process, which includes conventional technology and process of materials preparation, steaming, hot-pressing and glue adjustment and preparation, can only meet the standard of ordinary fiberboard. In recent years, a clear market segmentation phenomenon gradually occurred with the rapid development of fiberboard industry. In particular, users have an increasingly higher product quality standard requirements and environmental awareness. The market has an urgent need of a new type of high quality and environmental friendly fiberboard materials which is convenience for color match, water resistant, mildew resistant and has low formaldehyde emission to suit the need of market development in fashion and design industries. In response to the above market requirements, many manufacturers in this industry added paraffin or waterproofing agent to solve the moisture problem. Though this method may work well to prevent water moisture, this method has the problem of great variation of raw material quality, and does not provide the function of mildew resistant and bacteria inhibition. In view of the problem of formaldehyde emission, the formulation of the adhesive is adjusted. Urea-formaldehyde based resin is replaced by other resins of much high manufacturing cost. The use of methylene diphenyl isocyanate (MDI) resins or soybean bio-glue provides satisfactory effect but the production cost is very high and the price is very expensive, which is not affordable by general users.

SUMMARY OF THE PRESENT INVENTION

An object of the present invention is to provide a method of manufacture of medium and high density fiberboard which is moisture resistant, mildew resistant and has low formaldehyde emission. According to this method, the cost of manufacture is low, the function of moisture resistant, mildew resistant and low formaldehyde emission is enhanced, the time requirement for hot-pressing of the mat is reduced, the work efficiency is increased and the product quality is enhanced.

Additional advantages and features of the invention will become apparent from the description which follows, and may be realized by means of the instrumentalities and combinations particular point out in the appended claims.

According to the present invention, the foregoing and other objects and advantages are attained by a method of manufacture of medium and high density fiberboard, comprising the following steps:

(1) chipping step: chipping harvesting residual materials from brushwood and twigs in forestry industry by chipper machine into wood chips of uniform size;

(2) screening step: removing wood chips of unqualified chips and impurities from the wood chips in the step (1) through vibrating screen and air separator;

(3) pre-steaming step: feeding the wood chips from step (2) to a pre-steaming bin and then to a mill machine; the wood chips are pre-steamed by low-pressure steam with a steam temperature of 110-130° C. After softening, the wood chips are torn by roller type corkscrew with high compression ratio before conveying to the mill machine. The function of tearing is to prepare the wood chips for the subsequent steps. In the subsequent steaming process, steaming is facilitated and softness is uniform. The resulting fibers being produced are good in fiber morphology, uniform and soft. In the hot-pressing step, the time required for the deformation process through elastic deformation and plastic deformation is shortened, and therefore the control of water absorption of the product is facilitated and good physical properties are resulted.

(4) heating and milling step: breaking down the wood chips from the step (3) into fibers through the milling machine where the wood chips is processed by steaming under high temperature of 165-175° C. and high pressure of 0.8-0.9 MPa;

(5) drying step: feeding the fibers from the step (4) to a blow line and mixing activated carbon to the fibers in the blow line;

(6) fiber separation step: removing heavy fiber bundle, glue blocks and other impurities from the fibers obtained from the step (5) through air separator;

(7) mat formation step: under the mechanical pavement conditions, the dried fiber from the step (6) is fed to a feeding tank and laid onto an entire width of a mat formation platform uniformly through swinging action of the feeding tank and then forms a mat by pre-pressing;

(8) mat heating step: before moving the mat after pre-pressing from the step (7) to a pressing machine, pre-heating the fiber through a pre-heating system;

(9) heating and pressing: through the sandwiching action of steel belts of a double belt continuous press machine, moving the mat from the step (8) to the press machine, the mat is compressed between the moving upper and lower belts, the pressure is transmitted to the mat from press plates, rollers and steel strips through action of a hydraulic cylinder; based on the manufacturing requirements, the temperature of the press plates is adjusted precisely. The temperature is transmitted to the mat through the press plate, the roller and the steel strips. The mat is pressed continuously under high temperature and high pressure to complete the adhesive curing process and the deformation process through elastic deformation and plastic deformation;

(10) cutting step: cutting the board after continuous pressing from the step (9) through double diagonal saws into standard board of a particular size based on a particular requirement; moving the board after cutting through a roller conveyor to thickness and bubble detection; eliminating unqualified products and moving to the next step;

(11) cooling step: cooling the semi-finished product of fiberboard from the step (10) by a flip cooling machine to attain a core temperature below 60° C. and maintaining for 48 hours after flip cooling. For the semi-finished product of fiberboard just being produced, the urea-formaldehyde resin is not fully cured, the moisture distribution of the fiberboard is not uniform, the temperature difference between the core and the surface is great and the physical properties of the fiberboard is affected. Therefore, cooling is required.

(12) sanding and cutting step: polishing the fiberboard surface of the fiberboard from the step (11) by a sanding machine and cutting the sides by a cutting saw.

Preferably, the method of manufacture comprises following steps:

In the step (4): heating and milling step, the following ingredients are added: 200-230 kg/m$^3$ of urea-formaldehyde resin adhesive, 6-8 kg/m$^3$ of refined paraffin, 1.5-2 kg/m$^3$ of curing agent and nigrosine (acid black 2) solution. The nigrosine solution added is based on a quantity of nigrosine in solid form which amount to 1-1.2% of absolutely dried fiber: The melting and dissolving time for the nigrosine solution is 40-60 minutes and the standard is set at the time for the nigrosine to completely dissolve into a solution. Two tanks are preferred. One is for the ordinary addition and the other one is for dissolving the nigrosine. The two tanks are used alternately.

In the step (4): heating and milling step, water is added to nigrosine powder in a tank and then temperature is increased to 50-70° C., the mass ratio of water and nigrosine powder is 4:1 in the nigrosine solution, the nigrosine solution is passed through a screw pump to mix with the urea-formaldehyde resin adhesive to flow together and then added to the spraying pipe through a metering pump. The application amount to the spraying pipe is adjusted simultaneously based on the signal of fiber production amount from the heating and milling machine.

In the step (5) drying step, the fiber is dried and mixed with the activated carbon in the blow line under an airflow condition in which the inlet temperature is below 175° C., the outlet temperature is 50-70° C. and the flow rate is 30 m/s. The water content of the fiber after drying and mixing is controlled between 8-10%. The proportion of activated carbon in the absolutely dried fiber is 1%-10%.

In the step (5) drying step, the activated carbon is grinded into powder having a size of 100 mesh-200 mesh. The activated carbon powder undergoes spiral quantification and then is transported to the blow line through a fan to mix with the fiber completely. The application amount of the activated carbon is adjusted simultaneously based on the fiber production amount from the heating and milling machine. Based on the fiber production amount from the milling machine, the adjustment is realized through frequency conversion to adjust a rotation speed of the screw applicator.

In the step (3) pre-steaming step, the wood chips are pre-steamed by low-pressure steam with a steam temperature of 110-120° C. After softening, the wood chips are torn by roller type corkscrew with high compression ratio.

In the step (1) chipping step, the target chip size is: length: 16-30 mm, width: 15-25 mm, thickness: 3-5 mm.

In the step (6) fiber separation step, stabilizing the fiber temperature to 40° C.-60° C. and water content to 8%-10% through secondary heating. The qualified fiber is fed to a measuring silo. The unqualified fiber and impurities will sink by its gravity and transport to waste fiber silo through a slag spiral.

In the step (6) mat heating step, the pre-heating system employs steam for heating. The steam temperature for heating is 150° C.-170° C.

Compared to conventional method, the present invention has the following advantageous effect: The provision of well-mixed solution of nigrosine in the hot-pressing step and the addition of heated and activated carbon in the drying step has increased the product quality, enhanced the moisture resistance and mildew resistance and lowered the formaldehyde emission. The provision of pre-heating system in the mat heating process can preheat the fiber, increase the fiber temperature and soften the fiber. Therefore the time required in hot-pressing is shortened, the efficiency of hot-pressing is increased, the product quality is increased, the cost is lowered and the work efficiency is increased.

Still further objects and advantages will become apparent from a consideration of the ensuing description and drawings.

These and other objectives, features, and advantages of the present invention will become apparent from the following detailed description, the accompanying drawings, and the appended claims.

BRIEF DESCRIPTION OF THE DRAWINGS

FIG. 1 is an illustration of a method of manufacture of fiberboard according to a preferred embodiment of the present invention.

DETAILED DESCRIPTION OF THE PREFERRED EMBODIMENT

According to the preferred embodiment of the present invention, a method of manufacture of fiberboard is provided. The fiberboard refers to medium density fiberboard and high density fiberboard. In general, the medium density fiberboard is suitable for furniture and the high density fiberboard is suitable for floor. The fiberboard manufactured by the method of manufacture of the present invention is moisture resistant, mildew resistant and has low formaldehyde emission.

Referring to FIG. 1 of the drawings, the method of manufacture of fiberboard comprises the steps of: (a) stocking of wood based raw materials; (b) chipping of raw materials into wood chips; (c) screening of wood chips; (d) pre-steaming of wood chips;

(e) processing extrusion by plug screw (f) steaming; (g) milling and heating; (h) drying; (i) fiber selection; (j) fiber feeding tank; (k) fiber paving; (l) fiber pre-pressing; (m) pre-heating; (o) continuous pressing; (p) pre-trimming; (q) flip cooling; (r) stacking; (s) sanding and cutting; (t) inspection and classification; (u) product storage; and (v) product sales.

The unqualified products or intermediate products from different steps are supplied to a power plant for power generation to fuel the power generation process for the method of manufacture. The unqualified products includes the unqualified wood chips from screening step, unqualified fiber from filer separation of fiber and the sand powder from sanding and sawing steps.

The power plant is arranged to supply steam for pre-steaming, steaming, milling and heating processes; to supply smoke for the drying process; and to provide transmission oil for heating to the continuous pressing machine.

In the above method, refined paraffin, urea-formaldehyde resin adhesive, curing agent and nigrosine solution are added before the drying step.

In particular, the urea-formaldehyde resin adhesive and nigrosine solution are first mixed together before applying to the spraying pipe. The nigrosine solution is prepared by adding water to nigrosine powder under 50-70° C. to dissolve the nigrosine powder completely.

The fiber, is first passed through the spraying pipe in which the refined paraffin, the curing agent, the urea-formaldehyde resin adhesive and the nigrosine solution are added, and then is conveyed to a blow line for the drying step.

In the drying step, activated carbon is added by the following steps:

(a) Grinding the activated carbon into powder having a size of 100 mesh-200 mesh and remove impurities.

(b) Processing spiral quantification for the activated carbon and feeding the activated carbon through a fan to mix with the fiber in the blow line.

(c) Simultaneously adjusting the application amount of activated carbon based on the output of fiber from the milling machine. Based on the fiber production amount from the milling machine, the adjustment is realized through frequency conversion to adjust a rotation speed of the screw applicator.

The application amount of activated carbon is based on the mass percentage of activated carbon in absolutely dried fiber equals to 1-20%.

In particular, according to a preferred embodiment of the present invention, a method of manufacture of fiberboard comprises the following steps:

(a) chipping: chipping harvesting residual materials from brushwood and twigs from forestry industry by a chipper machine into wood chips of uniform size, wherein a standard size refers to the wood chip having a length of 16-30 mm, a width of 15-25 mm and a thickness of 3-5 mm;

(b) screening: screening wood chips to remove wood chips not having the standard size and impurities by vibrating screen and air separator;

(c) pre-steaming: transporting the wood chips to a steam-pressurized digester through which the wood chips are pre-steamed by low-pressure steam with a steam temperature of 110-130° C. Preferably, the pressure is 0.80-0.85MPa and the pre-steaming time is 3-5 minutes. The softened wood chips are then torn by roller type corkscrew with high compression ratio and transported to a pressurized refiner chamber;

(d) Refining: breaking down the wood chips into fibers through a pressurized refiner chamber of a milling machine in which the wood chips are steamed under high temperature and high pressure of 165-175° C. and 0.8-0.9MPa respectively. Before the fibers are transported to the blow line for drying, the fibers passes through a spraying pipe, where urea-formaldehyde resin adhesive, nigrosine solution, refined paraffin and curing agent are added. The amount of urea-formaldehyde resin adhesive added is 200-230 kg/m$^3$, the amount of refined paraffin is 6-8 kg/m$^3$, the amount of curing agent is 1.5-2 kg/m$^3$ and the amount of nigrosine solution added is based on the mass percentage of nigrosine powder in absolutely dried fiber equals to 1-1.2%.

(e) Drying: feeding the activated carbon to the blow line to mix with the fiber in the blow line, wherein the application amount is based on the mass percentage of activated carbon in absolutely dried fiber equals to 1-20%. The fiber is dried and mixed with the activated carbon in the blow line under an airflow effect in which the inlet temperature is below 175° C., the outlet temperature is 70° C. and the flow rate is 30m/s such that the water content of the fiber after drying and mixing is controlled between 8-10%.

(f) Air separation: removing heavy fiber bundle, glue blocks and other impurities from the fibers and stabilizing the fiber temperature to 40° C.-60° C. and water content to 8%-10% through secondary heating and then conveyed the fiber to a measuring silo. The unqualified fiber and impurities will sink by its gravity and transport to waste fiber silo through a slag spiral.

(g) Mat forming: under the mechanical pavement conditions, the dried fiber is fed to a feeding tank and laid onto an entire width of a mat formation platform uniformly through swinging action of the feeding tank and then forms a mat by pre-pressing. The mat scale detects the weight of the mat continuously and automatically to ensure an even distribution of weight on the mat formation platform. The sweeping roll adjusts the mat thickness through rolling action on the mat surface. The mat density is monitored automatically through real-time detection of density variation along a transverse direction by scanner and adjusted automatically through keying. Therefore, a mat of even distribution of density and flat surface is obtained. The mat formed is processed by pre-pressing machine. The density of the mat is increased by pre-pressing, the excess water from the resin application process is removed by the exhausted air, the interleaving force between fibers is increased and the thickness of the mat is decreased.

(h) mat pre-heating: the mat after pre-pressing but before processing by the continuous pressing machine, is arranged to pass through a steaming system for pre-heating the fiber such that the fiber temperature is increased, the fiber is softened and hence the hot-pressing time is reduced and the hot-pressing efficiency is increased. The fiber is heated continuously by superheated steam at 150-170 ° C. in this pre-heating step.

(i) hot-pressing: through the sandwiching action of steel belts of a double belt continuous press machine, moving the mat to the press machine through which the mat is compressed between the moving upper and lower belts while the pressure is transmitted to the mat from press plates, rollers and steel strips through action of a hydraulic cylinder. The press machine is heated continuously through a plurality units of hot oil heating system, each unit of the hot oil heating can be controlled separately and independently for temperature control. Accordingly the temperature of the press plates can be controlled precisely. The temperature is transmitted through the press plates, rollers and steel strips to the mat. The mat is processed continuously under high temperature and high pressure to complete the adhesive curing process and the deformation process through elastic deformation and plastic deformation to form a raw board.

(j) cross-section cutting: cutting the raw board after continuous pressing through double diagonal saws into standard board of a particular size based on particular requirements; then moving the board after cutting through a roller conveyor for thickness and bubble detection; eliminating unqualified products and moving to the next step.

(k) cooling: for the product of fiberboard just being produced, the urea-formaldehyde resin is not fully cured, the moisture distribution of the fiberboard is not uniform, the temperature difference between the core and the surface is great and the physical properties of the fiberboard is affected. Therefore, cooling is required. Cooling the product of fiberboard by a flip cooling machine to a core temperature below 60° C. and maintaining for 48 hours after flip cooling before sanding and cutting.

(l) sanding and cutting: after maintaining for 48 hours, the product of fiberboard is processed by sanding and cutting. Polishing the fiberboard surface of the fiberboard by a sanding machine and sawing the sides by a cutting saw to meet a particular size requirement.

(m) inspecting and storing: process inspection and grading by inspectors for the final product of fiberboard and then move to storage for sale.

The final product being produced by the above method is black in color. The method is suitable for use to manufacture medium and high density fiberboard. The nigrosine provides the water-resistant and mild-resistant function to the fiberboard. The activated carbon can adsorb the urea-formaldehyde and lower the emission of urea-formaldehyde from the fiberboard. Compared to the use of methylene diphenyl isocyanate (MDI) resins or soybean bio-glue, the cost of manufacture is reduced dramatically. Instead of switching to other resins to lower the formaldehyde emission, the use of activated carbon can effectively lower the urea-formaldehyde emission.

The final product being produced has good strength properties and low formaldehyde emission while the cost is low.

Preferred Embodiment 1

According to this embodiment of the present invention, a method of manufacture of fiberboard comprises the following steps:

(1) chipping step: chipping harvesting residual materials from brushwood and twigs in forestry industry by chipper machine into wood chips of uniform size;

(2) screening step: removing wood chips of unsuitable size and impurities from the wood chips in the step (1) through vibrating screen and air separator;

(3) pre-steaming step: feeding the wood chips from step (2) to a steam-pressurized digester and then transporting to a pressurized refiner chamber;

(4) heating and milling step: breaking down the wood chips from the step (3) into fibers by the pressurized refiner chamber of the milling machine through which the wood chips is pulp through steaming at high temperature and high pressure of 165-175° C. and 0.8-0.9 MPa respectively;

(5) drying step: feeding the fibers from the step (4) to a blow line and mixing activated carbon to the fibers in the blow line;

(6) fiber separation step: removing heavy fiber bundle, glue blocks and other impurities from the fibers obtained from the step (5);

(7) mat formation step: under the mechanical pavement conditions, the dried fiber from the step (6) is fed to a feeding tank and laid onto an entire width of a mat formation platform uniformly through swinging action of the feeding tank and then forms a mat by pre-pressing;

(8) mat heating step: before moving the mat after pre-pressing from the step (7) to a pressing machine, pre-heating the fiber through a pre-heating system;

(9) heating and pressing: through the sandwiching action of steel belts of a double belt continuous press machine, moving the mat from the step (8) to the press machine, the mat is compressed between the moving upper and lower belts, the pressure is transmitted to the mat from press plates, rollers and steel strips through action of a hydraulic cylinder; based on the manufacturing requirements, the temperature of the press plates is adjusted precisely. The temperature is transmitted to the mat through the press plate, the roller and the steel strips. The mat is pressed continuously under high temperature and high pressure to complete the adhesive curing process and the deformation process through elastic deformation and plastic deformation;

(10) cutting step: cutting the board after continuous pressing from the step (9) through double diagonal saws into standard board of a particular size based on a particular requirement; moving the board after cutting through a roller conveyor to thickness and bubble detection; eliminating unqualified products and moving to the next step;

(11) cooling step: cooling the semi-finished product of fiberboard from the step (10) by a flip cooling machine to a core temperature below 60° C. and maintaining for 48 hours after flip cooling. For the semi-finished product of fiberboard just being produced, the urea-formaldehyde resin is not fully cured, the moisture distribution of the fiberboard is not uniform, the temperature difference between the core and the surface is great and the physical properties of the fiberboard is affected. Therefore, cooling is required.

(12) sanding and cutting step: polishing the fiberboard surface of the fiberboard from the step (11) by a sanding machine and cutting the sides by a cutting saw;

(13) inspection and storage: process inspection and grading by inspectors for the final product of fiberboard from the step (12) and then move to storage.

In the heating and milling step, the following ingredients are added to the fibers: 200 kg/m$^3$ of urea-formaldehyde resin adhesive, 6 kg/m$^3$ of refined paraffin, 2 kg/m$^3$ of curing agent, nigrosine (acid black 2) solution accounting to 1.2% proportion of absolutely dried fiber: water is added to nigrosine powder in a tank and then temperature is increased to 50° C., the mass ratio of water and nigrosine powder is 4:1 in the nigrosine solution, the nigrosine solution is passed through a screw pump to the urea-formaldehyde resin adhesive to flow together and then added to the spraying pipe through an adhesive application pump.

In the drying step, the following ingredients are added: 100 mesh activated carbon powder after spiral quantification is added to the blow line through a fan to well mix with the fiber. The fiber is dried and mixed with the activated carbon in the blow line under an airflow effect in which the inlet temperature is below 175° C., the outlet temperature is 70° C. and the flow rate is 30m/s. The water content of the fiber after drying and mixing is controlled between 8-10%. The proportion of activated carbon in the absolutely dried fiber is 10%.

In the pre-steaming step, the wood chips are pre-steamed by low-pressure steam with a steam temperature of 120° C. After softening, the wood chips are torn by roller type corkscrew with high compression ratio.

In the chipping step, the target chip size is: length: 16-30 mm, width: 15-25 mm, thickness: 3-5 mm.

In the fiber separation step, stabilizing the fiber temperature to 50° C. and water content to 8%-10% through secondary heating. The qualified fiber is fed to measuring silo. The unqualified fiber and impurities will sink by gravity and transport to waste fiber silo through a slag spiral.

In the mat heating step, the pre-heating system employs steaming heating, and the steam temperature for heating is 160° C.

Preferred Embodiment 2

The followings are the differences between this preferred embodiment 2 and the preferred embodiment 1:

In the heating and milling step, the following ingredients are added: 230 kg/m$^3$ of urea-formaldehyde resin adhesive, 8 kg/m$^3$ of refined paraffin, 1.5 kg/m$^3$ of curing agent, nigrosine (acid black 2) solution accounting to 1% proportion of absolutely dried fiber: water is added to nigrosine powder in a tank and then temperature is increased to 60° C., the mass ratio of water and nigrosine powder is 4:1 in the nigrosine solution, the nigrosine solution is passed through a screw pump to the urea-formaldehyde resin adhesive to flow together and then added to the spraying pipe through an adhesive application pump.

In the drying step, the following ingredients are added: 150 mesh activated carbon powder after spiral quantification is added to the blow line through a fan to well mix with the fiber. The fiber is dried and mixed with the activated carbon in the blow line under an airflow effect in which the inlet temperature is below 175° C., the outlet temperature is 60° C. and the flow rate is 30 m/s. The water content of the fiber after drying and mixing is controlled between 8-10%. The proportion of activated carbon in the absolutely dried fiber is 15%.

In the mat heating step, the pre-heating system employs steaming heating, and the steam temperature for heating is 150° C.

Preferred Embodiment 3

The followings are the differences between this preferred embodiment 3 and the preferred embodiments 1 and 2:

In the heating and milling step, the following ingredients are added: 210 kg/m$^3$ of urea-formaldehyde resin adhesive, 7 kg/m$^3$ of refined paraffin, 1.6 kg/m$^3$ of curing agent, nigrosine (acid black 2) solution accounting to 1.1% proportion of absolutely dried fiber: water is added to nigrosine powder in a tank and then temperature is increased to 55° C., the mass ratio of water and nigrosine powder is 4:1 in the nigrosine solution, the nigrosine solution is passed through a screw pump to the urea-formaldehyde resin adhesive to flow together and then added to the spraying pipe through an adhesive application pump.

In the drying step, the following ingredients are added: 170 mesh activated carbon powder after spiral quantification is added to the blow line through a fan to well mix with the fiber. The fiber is dried and mixed with the activated carbon in the blow line under an airflow effect in which the inlet temperature is below 175° C., the outlet temperature is 50° C. and the flow rate is 30m/s. The water content of the fiber after drying and mixing is controlled between 8-10%. The proportion of activated carbon in the absolutely dried fiber is 17%.

In the mat heating step, the pre-heating system employs steaming heating, and the steam temperature for heating is 155° C.

Preferred Embodiment 4

The followings are the differences between this preferred embodiment 3 and the preferred embodiments 1, 2 and 3:

In the heating and milling step, the following ingredients are added: 220 kg/m3 of urea-formaldehyde resin adhesive, 7.5 kg/m3 of refined paraffin, 1.8 kg/m3 of curing agent, nigrosine (acid black 2) solution accounting to 1.15% proportion of absolutely dried fiber: water is added to nigrosine powder in a tank and then temperature is increased to 70° C., the mass ratio of water and nigrosine powder is 4:1 in the nigrosine solution, the nigrosine solution is passed through a screw pump to the urea-formaldehyde resin adhesive to flow together and then added to the spraying pipe through an adhesive application pump.

In the drying step, the following ingredients are added: 200 mesh activated carbon powder after spiral quantification is added to the blow line through a fan to well mix with the fiber. The fiber is dried and mixed with the activated carbon in the blow line under an airflow effect in which the inlet temperature is below 175° C., the outlet temperature is 65° C. and the flow rate is 30 m/s. The water content of the fiber after drying and mixing is controlled between 8-10%. The proportion of activated carbon in the absolutely dried fiber is 20%.

In the mat heating step, the pre-heating system employs steaming heating, and the steam temperature for heating is 170° C.

Testing:

The final product of fiberboard based on the manufacture method according to the present invention has been tested for formaldehyde emission rate.

Type of sample: MDF (medium density fiberboard)

Wood material: Poplar

Quantity and size: 50.8×152.4×12mm (3 pieces)

Sample thickness: 12 mm

Test standard: ASTM D6007-14: Standard test method for determining formaldehyde concentrations in air from wood products using a small-scale chamber Test method: The samples are remained sealed and stored in a room maintained at 50±5% RH, 24±3° C. (75±5° F.) prior to testing. The formaldehyde background concentration in the air where the specimens were conditioned was documented at <0.01ppm. The sample are then put into the chamber (850 mm×440 mm×520 mm, volume=6.92 cubic feet) and are maintained at 0.5 ACH for 150 minutes. The formaldehyde concentration of make-up air and the chamber are both measured at <0.01 ppm. After 120 minutes, air samples are drawn at a rate of 1 L/minute for 30 minutes. Emission values are determined with spectrophotometer analysis 7230G. The formaldehyde emissions are corrected to an emission level at standard condition (50% RH and 77° F.).

Test results: The formaldehyde emissions is 0.05 ppm under the following conditions: chamber Q/L ratio: 0.43, temperature: 77.4° F., relative humidity (RH): 50.3, Atmospheric pressure (Atm): 962.4 hpa.

Compared to the California standard, which is the strictest standard in the world with the limitation at 0.11 ppm for MDF, the MDF manufactured by the method of the present invention has a much lower formaldehyde emission rate than the required standard.

The final product of fiberboard based on the manufacture method according to the present invention has further been tested for the followings:

Surface binding strength: average: 2.4 MPa, minimum: 1.98 MPa

Internal binding strength: average: 1.9 MPa, minimum: 1.86 MPa

Static bending strength: average: 35 MPa, minimum: 34 MPa

Expansion rate of absorption thickness: average: 6%, maximum: 7%

Water content (%): 6%

Density: 0.88 g/cm$^3$

Board density deviation (%): −1.1~+1.1

In summary, the medium density fiberboard manufactured by the method of the present invention has achieved good strength properties, good moisture-resistant properties and a very low emission rate of formaldehyde.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method of manufacturing fiberboard comprising the steps of:

(a) providing wood chips;

(b) pre-steaming the wood chips by low-pressure steam having a steam temperature of 110-130° C.;

(c) refining the wood chips into fibers by steaming under 165-175° C. and 0.8-09 MPa through a milling machine and then adding urea-formaldehyde resin adhesive, nigrosine solution, refined paraffin and curing agent in a spray pipe;

(d) conveying the fibers from the spray pipe to a blow line and feeding activated carbon to the blow line through a fan to mix with the fibers and then drying the fibers to control a water content of the fibers to between 8-10%;

(e) separating fibers having the water content between 8-10% from heavy fiber bundles, glue blocks and other impurities and conveying to a measuring silo;

(f) laying the fibers onto a mat formation platform uniformly to form a fiber mat by pre-pressing;

(g) pre-heating the fiber mat to increase a temperature of the fibers and soften the fibers through spraying superheated steam; and (h) processing continuous hot-pressing under high temperature and high pressure to form a raw board.

2. The method of manufacturing fiberboard according to claim 1, wherein in the step (c), the nigrosine solution is prepared by dissolving nigrosine powder in water completely in which a mass ratio of water and nigrosine powder is 4:1 in the nigrosine solution, wherein an application of the urea-formaldehyde resin adhesive is 200-230 kg/m$^3$, an application of refined paraffin is 6-8 kg/m$^3$, an application of curing agent is 1.5-2 kg/m$^3$ and an application of nigrosine solution is based on a mass percentage of nigrosine powder in absolutely dried fiber of 1-1.2%.

3. The method of manufacturing fiberboard according to claim 1, wherein in the step (d), the activated carbon is in powder form of 100-200 mesh and a mass percentage of activated carbon in absolutely dried fiber equals to 1-20%.

4. The method of manufacturing fiberboard according to claim 2, wherein in the step (d), the activated carbon is in powder form of 100-200 mesh and a mass percentage of activated carbon in absolutely dried fiber equals to 1-20%.

5. The method of manufacturing fiberboard according to claim 1, wherein in the step (c), comprises the steps of:

dissolving nigrosine powder in water completely under 50-70° C., where a mass ratio of water and nigrosine powder is 4:1 in a tank;

adding the nigrosine solution to the urea-formaldehyde resin adhesive to flow together through a screw pump;

applying a mixture of the nigrosine solution and the urea-formaldehyde resin adhesive to a spray pipe through a metering pump;

conveying the fibers to pass through the spray pipe and simultaneously adjusting an application amount based on a production amount of fiber from the milling machine such that the application amount of the urea-formaldehyde resin adhesive is 200-230 kg/m$^3$, the application amount of refined paraffin is 6-8 kg/m$^3$, the application amount of curing agent is 1.5-2 kg/m$^3$ and the application amount of nigrosine solution is based on a mass percentage of nigrosine powder in absolutely dried fiber of 1-1.2%.

6. The method of manufacturing fiberboard according to claim 3, wherein in the step (d), the blow line is under an airflow effect in which an inlet temperature is below 175° C., an outlet temperature is 50-70° C. and the flow rate is 30 m/s to well mixing the activated carbon with the fibers and to dry the fibers to control the water content of the fibers to between 8-10%.

7. The method of manufacturing fiberboard according to claim 4, wherein in the step (d), the blow line is under an airflow effect in which an inlet temperature is below 175° C., an outlet temperature is 50-70° C. and the flow rate is 30 m/s to well mixing the activated carbon with the fibers and to dry the fibers to control the water content of the fibers to between 8-10%.

8. The method of manufacturing fiberboard according to claim 5, wherein in the step (d), further comprising the steps of:

(d1) grinding the activated carbon into powder having a size of 100 mesh-200 mesh and remove impurities;

(d2) processing spiral quantification for the activated carbon for feeding the activated carbon to the blow line; and (d3) simultaneously and automatically adjusting an application amount of activated carbon based on an output amount of fiber from the step (c), wherein the blow line is under an airflow effect in which an inlet temperature is below 175° C., an outlet temperature is 50-70° C. and the flow rate is 30 m/s to well mixing the activated carbon with the fibers and to dry the fibers such that a water content of the fibers is controlled between 8-10%.

9. The method of manufacturing fiberboard according to claim 4, before the step (c), the wood chips which are softened by pre-steaming in the step (b) are then torn by a roller type corkscrew with high compression ratio for facilitating the subsequent refining steps to produce fibers with good morphology and uniform softness and to shorten the time for fiber formation.

10. The method of manufacturing fiberboard according to claim 8, before the step (c), the wood chips which are softened by pre-steaming in the step (b) are then torn by a roller type corkscrew with high compression ratio for facilitating the subsequent refining steps to produce fibers with good morphology and uniform softness and to shorten the time for fiber formation.

11. The method of manufacturing fiberboard according to claim 4, after the step (h), comprising the steps of:

(i) pre-trimming the raw board to a preset size;

(j) cooling the raw board to a core temperature below 60° C. by flip cooling and maintaining for at least 48 hours; and (k) sanding and cutting the raw board to obtain final products.

12. The method of manufacturing fiberboard according to claim 10, after the step (h), comprising the steps of:

(i) pre-trimming the raw board to a preset size;

(j) cooling the raw board to a core temperature below 60° C. by flip cooling and maintaining for at least 48 hours; and (k) sanding and cutting the raw board to obtain final products.

13. The method of manufacturing fiberboard according to claim 11, wherein the final products has a formaldehyde emission rate of approximately 0.05 ppm under a standard test using a small-scale chamber.

14. The method of manufacturing fiberboard according to claim 12, wherein the final products has a formaldehyde emission rate of approximately 0.05 ppm under a standard test using a small-scale chamber.

15. The method of manufacturing fiberboard according to claim 11, in the step (a), further comprising the steps of:

(a1) chipping harvesting residual materials from brushwood and twigs in forestry industry by chipper machine into wood chips of uniform size to meet a size requirement of 16-30 mm in length, 15-25 mm in width and 3-5 mm in thickness; and (a2) screening the wood chips through vibrating screen and air separator to remove unqualified wood chips and impurities.

16. The method of manufacturing fiberboard according to claim 14, in the step (a), further comprising the steps of:

(a1) chipping harvesting residual materials from brushwood and twigs in forestry industry by chipper machine into wood chips of uniform size to meet a size requirement of 16-30 mm in length, 15-25 mm in width and 3-5 mm in thickness; and (a2) screening the wood chips through vibrating screen and air separator to remove unqualified wood chips and impurities.

17. The method of manufacturing fiberboard according to claim 15, comprising the step of: providing a power plant to supply power for the process of manufacturing fiberboard, wherein the unqualified wood chips, the unqualified fibers and fiberboard powder form cutting and sawing are fed to fuel the power plant.

18. The method of manufacturing fiberboard according to claim 16, comprising the step of: providing a power plant to supply power for the process of manufacturing fiberboard, wherein the unqualified wood chips, the unqualified fibers and fiberboard powder form cutting and sawing are fed to fuel the power plant.

19. A fiberboard, manufactured by the steps of:

(a) providing wood chips;

(b) pre-steaming the wood chips by low-pressure steam having a steam temperature of 110-130° C.;

(c) refining the wood chips into fibers by steaming under 165-175° C. and 0.8-09 MPa through a milling machine, then conveying to a spray pipe and adding urea-formaldehyde resin adhesive, nigrosine solution, refined paraffin and curing agent in the spray pipe;

(d) conveying the fibers from the spray pipe to a blow line and feeding activated carbon to the blow line through a fan to mix with the fibers and then drying the fibers to control a water content of the fibers to between 8-10%;

(e) separating fibers having the water content between 8-10% from heavy fiber bundles, glue blocks and other impurities and conveying to a measuring silo;

(f) laying the fibers onto a mat formation platform uniformly to form a fiber mat by pre-pressing;

(g) pre-heating the fiber mat to increase a temperature of the fibers and soften the fibers through spraying superheated steam;

(h) processing continuous hot-pressing under high temperature and high pressure to form a raw board;

(i) pre-trimming the raw board to a preset size;

(j) cooling the raw board to a core temperature below 60° C. by flip cooling and maintaining for at least 48 hours; and (k) sanding and cutting the raw board to obtain final products.

20. The fiberboard according to claim 19, wherein in the step (c), the nigrosine solution is prepared by dissolving nigrosine powder in water completely in which a mass ratio of water and nigrosine powder is 4:1 in the nigrosine solution, wherein an application of the urea-formaldehyde resin adhesive is 200-230 kg/m$^3$, an application of refined paraffin is 6-8 kg/m$^3$, an application of curing agent is 1.5-2 kg/m$^3$ and an application of nigrosine solution is based on a mass percentage of nigrosine powder in absolutely dried fiber of 1-1.2%, wherein in the step (d), the activated carbon is in powder form of 100-200 mesh and a mass percentage of activated carbon in absolutely dried fiber equals to 1-20%, wherein in the step (a), the wood chips are of uniform size meeting a size requirement of 16-30 mm in length, 15-25 mm in width and 3-5 mm in thickness, wherein before the step (c), the wood chips which are softened by pre-steaming in the step (b) are then torn by a roller type corkscrew with high compression ratio for facilitating the subsequent refining steps to produce fibers with good morphology and uniform softness and to shorten the time for fiber formation.

* * * * *